US005159826A

United States Patent [19]

Miyazawa et al.

[11] Patent Number: 5,159,826

[45] Date of Patent: Nov. 3, 1992

[54] DIE SET FOR MANUFACTURING FINS OF HEAT EXCHANGERS AND A MANUFACTURING DEVICE USING THE SAME

[75] Inventors: Toshiki Miyazawa; Masahide Sakaguchi; Hideki Okabe, all of Tokyo, Japan

[73] Assignee: Hidaka Seiki Kabushiki Kaisha, Tokyo, Japan

[21] Appl. No.: 728,734

[22] Filed: Jul. 11, 1991

[30] Foreign Application Priority Data

Jul. 19, 1990 [JP] Japan ..... 2-191082
Sep. 13, 1990 [JP] Japan ..... 2-243005

[51] Int. Cl.[5] ..... B21D 53/04
[52] U.S. Cl. ..... 72/358; 72/335
[58] Field of Search ..... 72/327, 328, 335, 358

[56] References Cited

U.S. PATENT DOCUMENTS 2,821,156 1/1958 Lyon ..... 72/463
2,861,335 11/1958 Huet ..... 72/358
3,116,542 1/1964 Niekamp ..... 72/327
3,146,749 9/1964 Heinle ..... 72/335
4,055,067 10/1977 Kozima .
4,956,989 9/1990 Nakajima ..... 72/327

FOREIGN PATENT DOCUMENTS 0039599 11/1981 European Pat. Off. ..... 72/358

*Primary Examiner*—Lowell A. Larson

[57] ABSTRACT

A die set for forms fins of heat exchangers and a manufacturing device using the die set. The die set for manufacturing fins of heat exchangers, comprising a punch and a die for forming a projected section, which is formed along an edge of a hole bored in a metal plate, into a collar with a prescribed height. The die has a hollow section into which the punch is capable of entering and the outer circumferential face of the punch is a tapered face in the form of a truncated cone. The tapered face faces the inner face of the die when the upper end section of the punch proceeds beyond the upper end of the projected section, which is held between the outer circumferential face of the punch and the inner face of the die, and the projected section so held is extruded by reduction of the distance between the outer circumferential face of the punch and the inner face of the die, which hold the projected section therebetween, caused by movement of the tapered face of the punch into the hollow section of the die.

25 Claims, 8 Drawing Sheets

DIE SET FOR MANUFACTURING FINS OF HEAT EXCHANGERS AND A MANUFACTURING DEVICE USING THE SAME

BACKGROUND OF THE INVENTION

The present invention relates to a die set for manufacturing fins of heat exchangers and a manufacturing device using the same. More precisely, the present invention relates to a die set comprising a punch and a die for forming a projected section, which is formed along an edge of a hole bored in a metal plate, into a collar with a prescribed height and a manufacturing device using the same.

Heat exchangers for car radiators, room air conditioners, etc. have heat exchanging fins, which are made of thin, rectangular metal (e.g. aluminum) plate and in which a multiplicity of through-holes with collars are bored.

In the heat exchangers, a plurality of fins are stacked such that their through-hole coincide, then tubes which are made of a highly thermal conductive metal such as copper are inserted through the coincidental through-holes so as to assemble the fins as a single heat exchanger.

A method of manufacturing the above described fins was disclosed in the U.S. Pat. No. 4,055,067. This method will be described with reference to FIGS. 10A–10D.

First, a through-hole 101 is bored into plate 100, and then the edge of the through hole 101 is rounded into a projected section 102 by a burring process (see FIG. 10A) wherein the edge of the through-hole 101 is stamped to form a circular, raised surface, e.g. said projected section 102.

Next, the diameter of the through-hole 101 is enlarged and the projected section 102 is ironed to form the projected section 102 into a collar 104 with a prescribed height (see FIGS. 10B and 10C), wherein the ironing process is the pressing of the projected section against an interior wall of a die and the deforming of the projected section primarily from the interior face by a circumferential corner section of a punch inserted into the die.

In FIGS. 10B and 10C, the ironing step is executed twice and the diameter of punch and die for the first step is different from that of the second step.

The upper end of the collar 104, which is formed by the above described ironing operation, is then bent to form a flange 105 (see FIG. 10D).

The above described method is executed by a punch and a die as shown in FIGS. 11A and 11B.

The metal plate 100 is held between a die 110 and a stripper-plate 112, and the projected section 102 is inserted into a hollow section of the die 110 (see FIG. 11A).

Next, the diameter of the through-hole 101 is enlarged by a punch 114, which moves upward from the level of the metal plate 100, so that the projected section 102 is ironed to form the collar 103 with a prescribed height (see FIG. 11B).

The ironing operation is executed by an ironing section 116, which is formed in the upper end section of the punch 114, and the inner face of the die 110, which corresponds to the ironing section 116 when the punch 114 enters the die 110.

In the ironing operation shown in FIGS. 11A and 11B, involatile oil is usually used as machining oil.

When involatile oil is used, some of the oil remains on the ironed fin. To remove the oil, Freon has been used. However, Freon's usage has been limited because of its impact on the environment, and it may be prohibited in the near future to use Freon as a solvent for cleaning the residual oil.

To solve this problem, the inventors tried to use volatile oil instead of involatile oil so as to enable cleaning of the ironed fin without using Freon. However, when using volatile oil, the malleability of the metal plate 100 is less in comparison to the case of using involatile oil. Therefore, the resulting height of the collar is quite lower.

Currently, when using thin and hard metal plates to form fins, it is very difficult to form significantly higher collars because of the lower malleability caused by volatile oil.

Moreover, hydrophile coated metal plates (e.g. hydrophile coated aluminum plate) are used because of increased thermal conductivity. If a hydrophile coated metal plate is ironed by the punch and the die shown in FIGS. 11A and 11B at the ordinary ironing rate, the hydrophilic coating on the inner face, which is the face ironed, is peeled off. A heat exchanger having fins whose hydrophile coating was peeled off cannot perform the designed heat exchange. The inventors thought that if the projected section 102 is formed without ironing or without substantial ironing, the destruction of the hydrophilic coating can be prevented.

SUMMARY OF THE INVENTION

An object of the present invention is to provide a die set, which is capable of forming projected sections on heat exchanger fin material without substantial ironing so as to easily form collars with prescribed height, and a manufacturing device having the same.

The inventors observed the ironing mechanism of the punch and the die shown in FIGS. 11A and 11B, and they found out that only the ironing section 116, which is the circumferential corner defining the intersection of the punch shaft 114 and the tapered upper end section of the shaft which serves only as a guide, works to make the collar 103 higher. The inventors determined that if the projected section is extruded by pressing between the outer circumferential face of the punch and the inner face of the die with a substantially greater area of contact and with deformation occurring equally at both contacting surfaces, the projected section is capable of being extruded to form a higher collar without substantial ironing, without destruction of a hydrophilic coating, and without use of involatile oils.

In the present invention, a die set comprises a punch and a die for forming a projected section, which is formed along an edge of a hole punched in a metal plate, into a collar with a prescribed height, is characterized in that: the die has a hollow section into which the punch is capable of entering; and the outer circumferential face of the punch is a tapered face in the form of a truncated cone, wherein the tapered face faces the inner face of the die when the front end section of the punch proceeds beyond the front end of the projected section, which is held between the outer circumferential face of the punch and the inner face of the die, and the projected section so held is extruded by a reduction of the distance between the outer circumferential face of the punch and the inner face of the die, which hold the projected section therebetween, caused by movement of the tapered face of the punch into the hollow section of the die.

And a device comprises an upper die-set-member and a lower die-set-member for forming a projected section, which is formed along an edge of a hole bored in a metal plate, into a collar with a prescribed height, is characterized in that: the upper die-set-member has: an upper base being capable of reciprocating vertically; a die being fixed vertically to the upper base and extended vertically downward, and having a hollow section whose inner diameter is very slightly greater than the outer diameter of the collar at the lower end; hollow cylindrical knock-out bushing being provided in the hollow section of the die, the knock-out-bushing being capable of reciprocating vertically, and being biased downward by a first biasing means so that the lower end of the knock-out bushing is located below the lower end of the die when the knock-out bushing is positioned at the lowest limit of its travel; and a pierce-punch being formed like a rod, being provided in the knock-out bushing, being capable of reciprocating vertically coincidental to a corresponding movement of the upper base, and whose outer diameter is larger than the inner diameter of the collar, and the lower die-set-member has: a lower base; a punch being fixed to the lower base and extended vertically upward to correspond to the die, and which has a hollow section whose outer diameter is slightly less than the inner diameter of the collar, and the upper end section of the punch is a tapered section in the form of a truncated cone, wherein the punch enters the die and the pierce-punch enters the punch when the upper die-set-member moves downward; and a biased plate being biased upward by a second biasing member, the biased plate loosely penetrated by the punch whose tapered section is projected therefrom, wherein the tapered section of the punch faces to the inner face of the die when the upper end section of the punch proceeds beyond the upper end of the projected section, which is held between the outer circumferential face of the punch and the inner face of the die, and the projected section so held is extruded by reduction of the distance between the outer circumferential face of the punch and the inner face of the die, which hold the projected section therebetween.

In the conventional die-set, the projected section is formed by only the ironing section, which is positioned in the front end section of the punch, so that the punch does not deform the projected section any further after the ironing section has passed beyond the top edge of the projected section, regardless of the distance the punch proceeds further into the die.

On the other hand, in the present invention wherein no ironing section as required by prior art exists, the projected section is pressed between the relatively large areas of the outer circumferential face of the punch and the inner face of the die, so that the height of the collar can be increased with upward movement of the punch. Therefore, the projected section can be extruded until the prescribed height is attained without any substantial ironing. Furthermore, volatile oil can be used as machining oil because of the high degree of extrusion made possible by the design of the present invention. Thin and hard metal plates and hydrophile coated metal plates with high thermal conductivity can be used. And, in the manufacturing device of the present invention, the through-holes with collars can be made in one step, so that machining accuracy and machining efficiency can be increased.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will be apparent from the following description, reference being had to the accompanying drawings which are given by way of illustration only, and thus are not limitative of the present invention, and wherein preferred embodiments of the present invention are clearly shown.

In the drawings.

DETAILED DESCRIPTION OF PREFERRED EMBODIMENTS

Preferred embodiments of the present invention will now be described in detail with reference to accompanying drawings.

Figure 1:
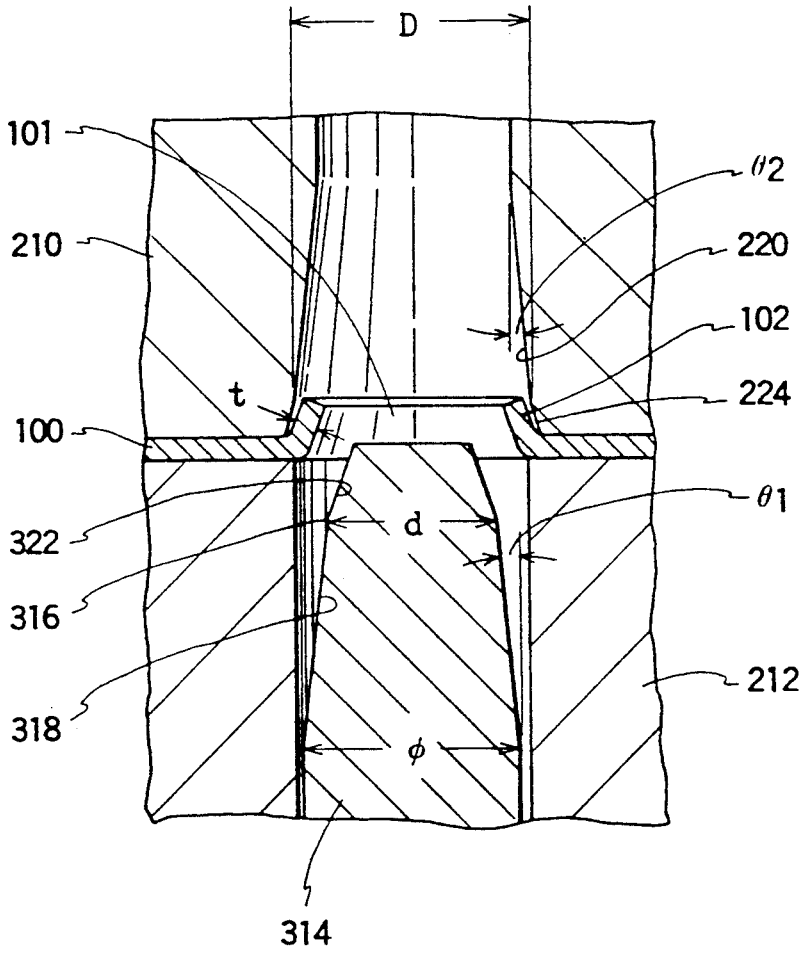
FIG. 1 is a sectional view of a die set of an embodiment of the present invention.

FIG. 1 shows a sectional view of an embodiment of the present invention.

A metal plate 100 is held between a die 210 and a stripper-plate 212.

A projected section 102, whose top edge defines a through-hole 101, is inserted into a hollow truncated conical section of the die 210 so that the outer circumferential face of the projected section 102 is located in the vicinity of the inner face of the hollow section of the die 210. Below the through-hole 101, a punch 314 is slidably provided in a hole in the stripper-plate 212, and is capable of reciprocating vertically.

The punch 314 has a first tapered face 322, which is formed on the outer circumferential face of the front end section, and a second tapered face 318, which is proximate to the first tapered face 322. The angle $\theta 1$ of the second tapered face 318 is from 1 to 4 degrees (preferably from 1 to 3 degrees, further preferably from 1.5 to 2 degrees), and furthermore, the angle $\theta 1$ is less than the angle of the first tapered face 322.

In this structure, the diameter d of the intersection of the second tapered face 318 and the first tapered face 322, the minimum inner diameter D of the part of the hollow section of the die 210 in which the projected section 102 is inserted, and the thickness t of the projected section 102 satisfy the following equation (1):

$$(D-d)/2 \geqq t \quad (1).$$

The lower end diameter $\phi$ of the second tapered section is larger than the upper end diameter d thereof, and satisfies the following equation (2):

$$(D-\phi)/2 < t \quad (2).$$

In the present embodiment, there are formed a first reverse-tapered face 224 in the form of a hollow truncated cone and a second reverse-tapered face 220 in the form of a hollow truncated cone on the inner face of the hollow section of the die 214, into which the punch 314 enters.

The first reverse-tapered face 224 is formed in the lower end section of the die 210, and the second reverse-tapered face 220 is coaxial and adjacent to the first reverse-tapered face 224. The angle $\theta 2$ of the second tapered face 220 is equal to the angle $\theta 1$ of the second tapered face 318 of the punch 314: from 1 to 4 degrees (preferably from 1 to 3 degrees, further preferably from 1.5 to 2 degrees). And the angle $\theta 2$ is less than the angle of the first reverse-tapered face 224.

The first tapered face 322 of the punch 314 and the first reverse-tapered face 224 of the die 210 are formed in order to guide the punch 314 and the projected section 102, respectively.

In FIG. 1, the upper end section of the punch 314 enters the hollow section of the die 210 in which the projected section 102 has been inserted, and because the diameter d which defines a corner section 316 of the punch 314 satisfies the equation (1), first tapered face 322 projects upward from the upper end of the projected section 102 without substantially ironing the projected section 102 against the inner face of the die 210.

Figure 2A:
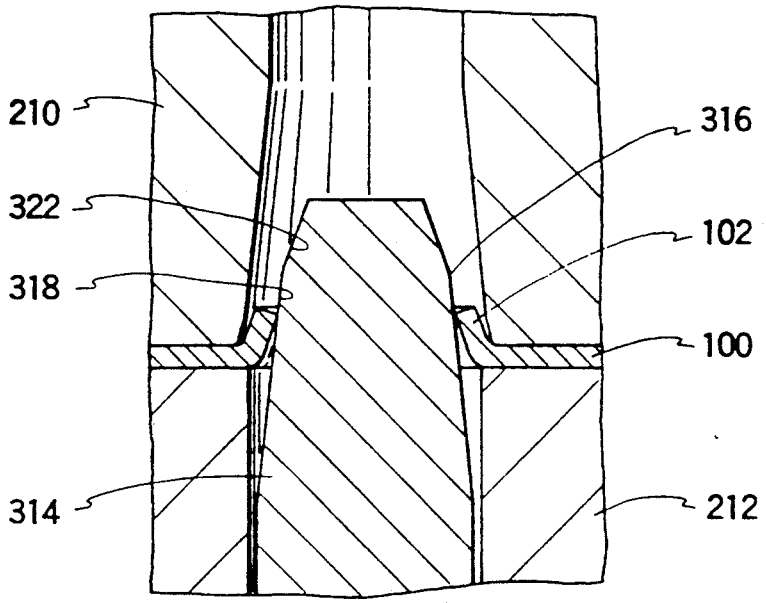
FIGS. 2A and 2B are sectional views showing the action of the die set shown in FIG. 1.

In this embodiment, the diameter d of the punch 314 satisfies the equation (1) and is less than the minimum inner diameter of the projected section 102, so that mutual contact between the outer circumferential face of the punch 314 and the inner face of the projected section 102 begins on a plane through the second tapered face 318 which is below the corner section 316. Furthermore, in this embodiment, the lower end diameter $\phi$ satisfies the equation (2). After the punch 314 enters the hollow section of the die 210 (see FIG. 2A), the distance between the entire length of the second reverse-tapered face 220 of the die 210 and the entire length of the second tapered face 318 of the punch 314 is uniformly reduced by procession of the punch 314 into the hollow section of the die 210 so as to evenly reduce the thickness t of the entire projected section 102 (see FIG. 2B). In the reduction of the thickness t, the projected section 102 located between the faces 220 and 318 is extruded thereby (see FIG. 3).

Figure 3:
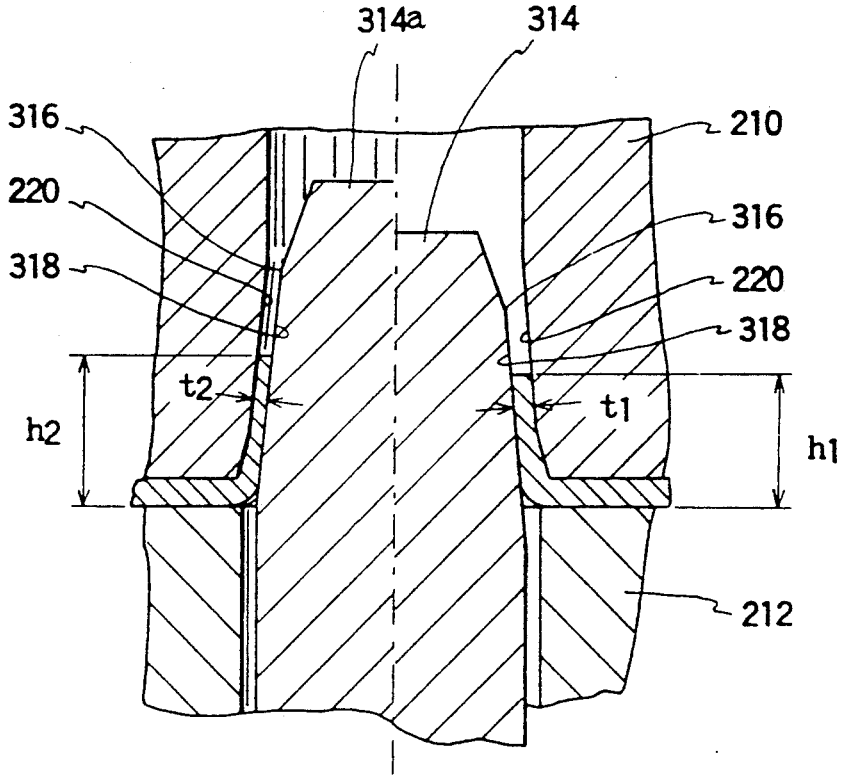
FIG. 3 is a sectional view showing the action of the die set shown in FIGS. 1, 2A and 2B.

In FIG. 3, the punch 314, whose corner section 316 is located above the upper end of the projected section 102, is advanced to the location 314*a* in the die 210. The faces 220 and 318 are parallel because the angle $\theta 1$ is equal to the angle $\theta 2$, so the minimum distance between the faces 220 and 318 is the normal distance therebetween.

With the movement of the punch 314 toward the location 314*a*, the minimum distance t1 between the second tapered face 318 of the punch 314 and the second reverse-tapered face 220 of the die 210 is decreased to t2 because the faces 220 and 318 are parallel. Therefore, the projected section 102 is extruded by both the faces 220 and 318 with the movement of the punch 314, so that the height h1 of the projected section 102 is increased to h2 by reduction of the thickness t1 to t2.

With the punch 314 and the die 210 shown in FIGS. 1–3, the projected section 102 is extruded by pressure exerted by the faces 220 and 318, and said pressure is caused by advancing the punch 314 into the die 210. In this case, the projected section 102 is not ironed by the corner section 316 so that any hydrophilic coating is not peeled off. In the conventional die set, if a hydrophile coated metal plate is ironed by the punch and the die with an ordinary ironing rate, the hydrophile coating on the inner face, which is the face ironed, is peeled off. A heat exchanger having fins whose hydrophilic coating was peeled off cannot perform the designed heat exchange.

By adjusting the distance of travel of the punch 314 into the die 210, the height of the projected section 102 can be easily adjusted while maintaining uniform thickness of the projected section 102. In the conventional die set, it is necessary to change the diameter of a punch and a die in order to adjust the height of the projected section 102 while maintaining the thickness of the projected section 102.

In the die set shown in FIGS. 1–3, the upper end diameter d of the second tapered section 318 of the punch 314 is less than the minimum inner diameter of the projected section 102 but the diameter d may be larger than the minimum inner diameter as long as the diameter d is satisfies the equation (1). In this case, when the upper section of the punch 314 enters the hollow section of the die 210, the inner diameter of the through-hole 101 is enlarged and the projected section 102 is pressed against the inner face of the hollow section of the die 210 with resulting extrusion of the projected section 102 without substantial ironing.

In a case where the diameter d is slightly greater than the range defined by the equation (1) but in the range defined by the equation $(D-d)/2 < t$, and the lower end diameter $\phi$ satisfies the equation (2), the projected section 102 can be extruded properly. In this case, the projected section 102 is formed by both ironing and extrusion. This method will be explained with reference to FIGS. 4A and 4B.

Figure 4A:
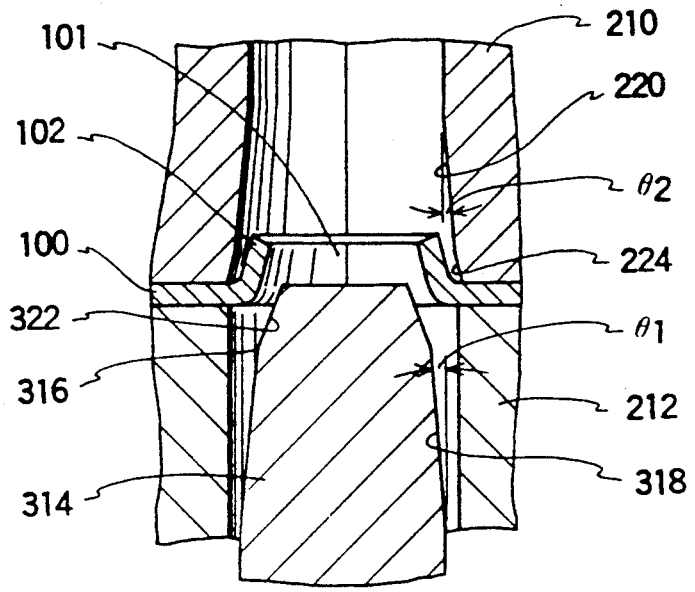
FIGS. 4A and 4B are sectional views showing action of a die set of another embodiment.

In FIG. 4A, the metal plate 100 is held between the die 210 and the stripper-plate 212, and the projected section 102, whose edge defines the through-hole 101, is inserted into the hollow section of the die 210. Below the through-hole 101, there is inserted the punch 314 into the hole of the stripper-plate 212. The punch 314 is capable of reciprocating vertically. The punch 314 has the first tapered face 322 in form of a truncated cone, which is formed in the upper end section, and the second tapered section 318 which is also formed as a truncated cone and which is coaxial to and adjacent to the first tapered face 322. The angle $\theta 1$ of the second tapered face 318 is between 30 minutes and 4 degrees, and it is less than the angle of the first tapered face 322.

In the present embodiment, there are formed the first reverse-tapered face 224 as a hollow truncated cone and the second reverse-tapered face 220 as a hollow truncated cone on the inner face of the hollow section of the die 210 into which the punch 314 is advanced. The first reverse-tapered face 224 is formed in the lower section of the die 210, and the second reverse-tapered face 220 is coaxial and adjacent to the first reverse-tapered face 224. The angle $\theta 2$ of the second tapered face 220 is equal to the angle $\theta 1$ of the second tapered face 318 of the punch 314: between 30 minutes and 4 degrees. And the angle $\theta 2$ is less than the angle of the first reverse-tapered face 224. The first tapered face 322 of the punch 314 and the first reverse-tapered face 224 of the die 210 are formed in order to guide the punch 314 and the projected section 102.

The punch 314 is inserted into the hollow section of the die 210 in which the projected section 102 has been positioned, the diameter of the through-hole 101 is enlarged, and the projected section 102 is ironed by the corner section 316 (which is defined by the intersection of the first and the second tapered faces 322 and 318 of the punch 314) against the inner face of the die 210.

Figure 4B:
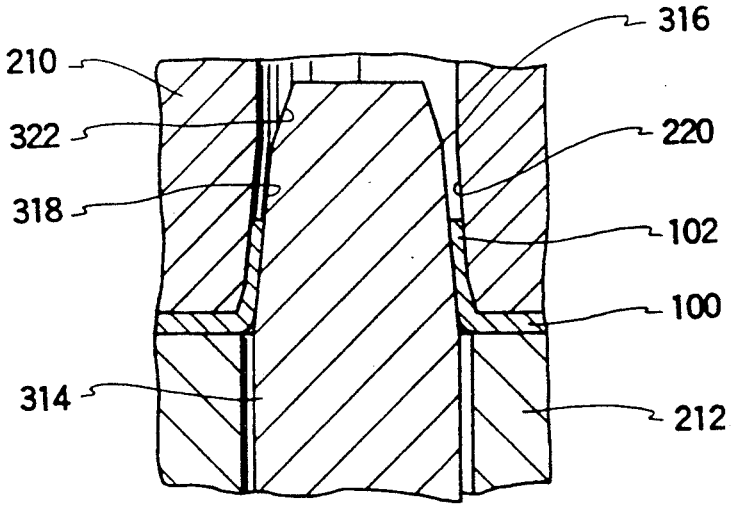

The corner section 316 moves upward as the punch 314 is advanced into die 210, so that the corner section 316 proceeds beyond the upper end of the projected section 102 (see FIG. 4B). When this occurs, the corner section 316 is no longer capable of ironing the projected section 102. In the present embodiment, the minimum distance between the second reverse-tapered face 220 of the die 210 and the second tapered face 318 of the punch 314 is decreased by upward movement of the punch 314 into the die 210 even after the corner section 316 is beyond the upper end of the projected section 102, so that the projected section 102 held by the faces 220 and 318 is pressed bilaterally with resulting extrusion to the desired height. This mechanism will be explained with reference to FIG. 3.

In FIG. 3, the punch 314, whose corner section 316 is located above the upper end of the projected section 102, is advanced to the position 314*a* in the die 210. The faces 220 and 318 are parallel because the angle $\theta 1$ is equal to the angle $\theta 2$, and the minimum distance between the faces 220 and 318 is the normal distance therebetween.

With the movement of the punch 314 toward the position 314*a*, the minimum distance t1 between the second tapered face 318 of the punch 314 and the second reverse-tapered face 220 of the die 210 is decreased to t2 because the faces 220 and 318 are parallel. Therefore, the projected section 102 is pressed and extruded bilaterally by the faces 220 and 318 with the advance of the punch 314, so that the height h1 of the projected section 102 is increased to h2 through reduction of the thickness t1 to t2.

With the punch 314 and the die 210 shown in FIGS. 4A and 4B, the projected section 102 is extruded by bilateral pressure from the faces 220 and 318 caused by advancing the punch 314 into the die 210, even when the corner section 316 is above the upper end of the projected section 102. And the amount of deformation caused by ironing relative to that caused by extrusion is very low, so the hydrophilic coating is not peeled off of a hydrophile coated plate.

Figure 5:
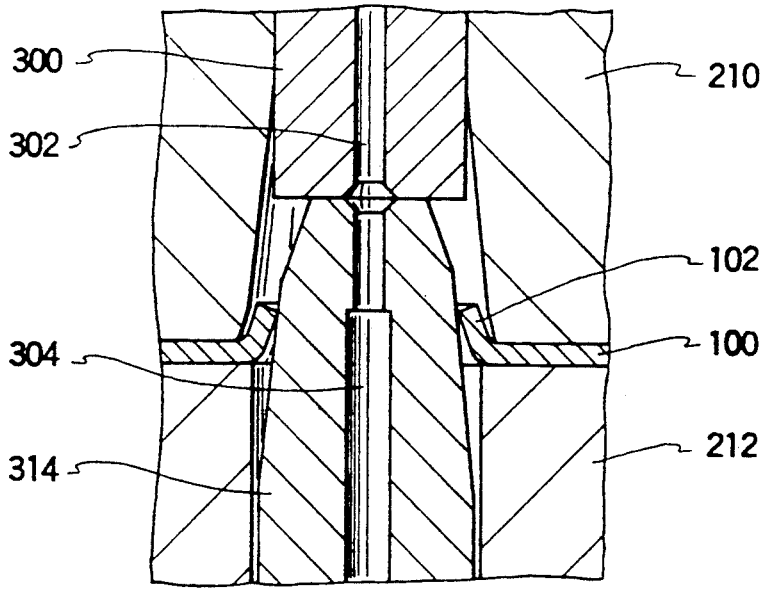
FIG. 5 is a sectional view of another embodiment.

As shown in FIG. 5, a knock-out 300 for ejecting the projected section 102 from the hollow section of the die 210 may be provided above the punch 314 in the die 210 shown in FIGS. 1-4A and 4B. The knock-out 300 is retracted upward by the advance of the punch 314, and descends along the inner face of the hollow section of the die 210 after the extrusion step.

There are provided oil paths 302 and 304 in the knock-out 300 and the punch 314. An air-oil mist is supplied to the projected section 102 via the paths 302 and 304. There are two oil paths 302 and 304 in this embodiment but both paths 302 and 304 are not always required; either path 302 or 304 will suffice in some cases. The oil may be supplied to the projected section 102 during extrusion. In the die set shown in FIGS. 1-5, the oil path may be provided in the punch 314.

In the present embodiment, both involatile oil and volatile oil can be used as machining oil but it is preferable to use volatile oil because no Freon is required for cleaning the fins. Even in the case of using volatile oil, higher collars can be extruded by the die set of the present embodiment. In this regard, the degree of ironing possible with the conventional die set when using volatile oil is, as described above, necessarily low, and so volatile oil cannot be effectively used as machining oil.

In the die 210 and the punch 314 shown in FIGS. 1-5, the angle $\theta 1$ is equal to the angle $\theta 2$ but the angle $\theta 1$ and $\theta 2$ may be different from each other. And the second reverse-tapered face 220 of the die 210 may be eliminated (see FIG. 6).

Figure 6:
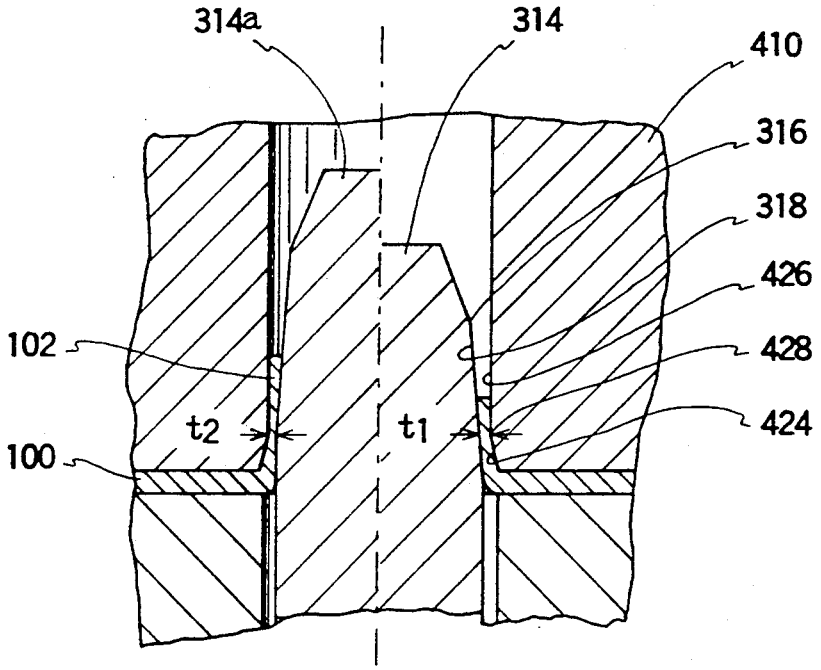
FIG. 6 is a sectional view of another embodiment.

In FIG. 6, the portion of the interior surface of the die 410 nearest the face 318, both of which have contacted the projected section 102, is a corner section 428, which is the intersection of faces 424 and 426. When the punch 314 is located the position shown as FIG. 6, the distance between the corner section 428 and the second tapered face 318 of the punch 314 is defined as t1. If the punch 314 proceeds to the location 314*a*, the distance is reduced from t1 to t2, so that the projected section 102 is further extruded and heightened.

Figure 7:
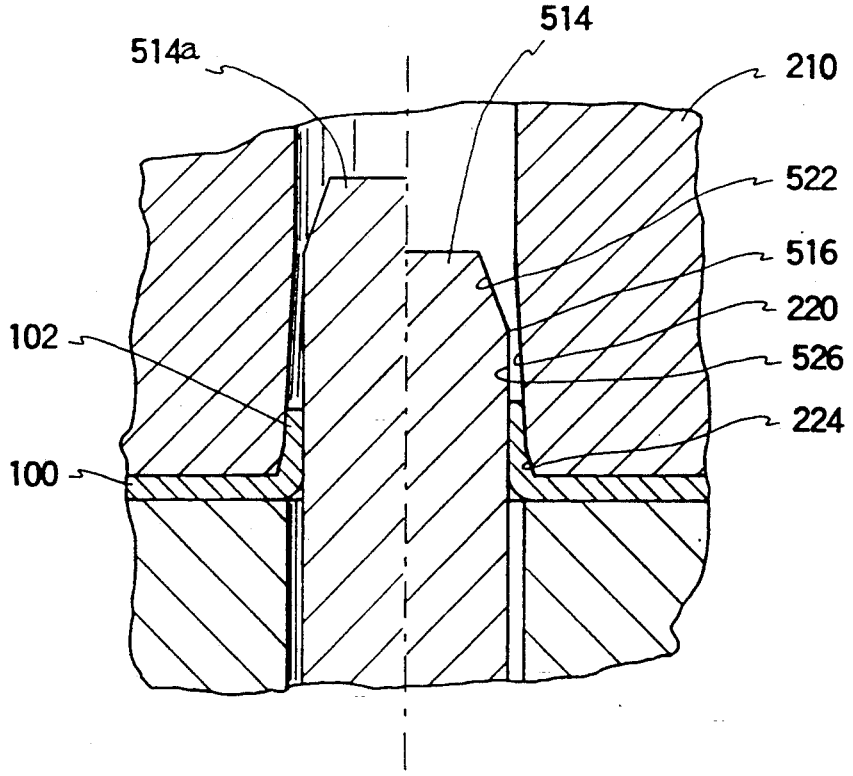
FIG. 7 is a sectional view of an example similar to former embodiments.

On the other hand, as shown in FIG. 7, if a vertical face 526 is adjacent to a first tapered face 522, which is formed in a upper end section of a punch 514, the projected section 102 cannot be extruded after a corner section 516, which is the intersection of faces 522 and 526 of the punch 514, proceeds beyond the upper end of the projected section 102 even if the die 210 has the first and the second reverse-tapered faces 224 and 220. Specifically, the least distance between the die 210 and the punch 514 is the distance between the corner section 516 and the inner face of the die 210. Therefore, after the corner section 516 proceeds beyond the upper end of the projected section 102, the projected section 102 cannot be pressed and extruded even if the punch 514 moves to the location 514*a*.

The die set shown in FIGS. 1-6 may be serially arranged together with a die set for burring a plate in the sequence shown in FIGS. 10A-10D. And preferably, they can assembled in a manufacturing device as shown in FIG. 8.

Figure 8:
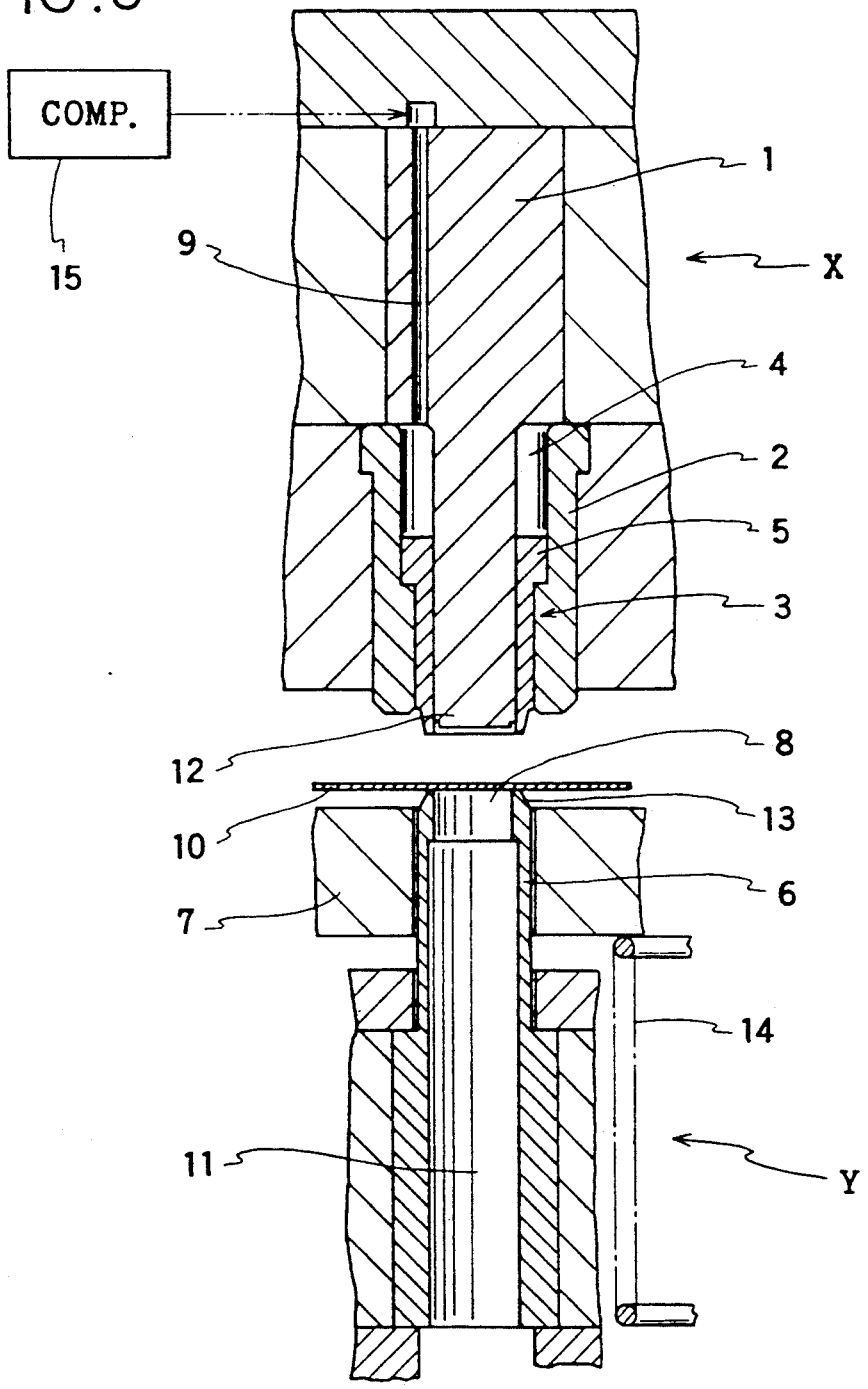
FIG. 8 is a partial sectional view of a device for manufacturing fins using the die sets shown in FIGS. 1–5.

In FIG. 8, a cylindrical bushing 2 is fixed to an upper base X, which consists of an upper die-set-member. The bushing 2 is vertically extended downward from the upper base X. There is formed in the bushing 2 a hollow stepped section, whose upper end inner diameter is larger than lower end inner diameter. The lower end section of the bushing 2 is an extrusion die. There are formed the first reverse-tapered face 224 and the second reversed-tapered face 220, whose angle $\theta 2$ is 2 degrees, (see FIGS. 1-6) in the hollow section of the bushing 2. Note that, the inner diameter of the hollow section is equal to the outer diameter of the collars.

There is provided a cylindrical knock-out bushing 3 in the hollow section of the bushing 2. The knock-out bushing 3 has a flange 5 at the upper end, and is capable of vertical reciprocation within the hollow section, wherein the flange 5 is capable of reciprocating vertically within the hollow section of bushing 2 of the greater diameter, but is limited in downward travel by the step in the hollow section at which the diameter reduction of the lower portion occurs. The knockout bushing 3 slidably engages a pierce-punch 1, which is fixed to the upper base X and extended vertically downwards, and which follows the motions of the upper base X. The outer diameter of the lower end section of the pierce punch 1, including a punching section 12, is less than the inside diameter of the projected section to be formed. The outer diameter of the punching section 12 is less than that of the adjacent lower end section of the pierce-punch 1. The difference is approximately 5–10% of the thickness of the metal plate 10 to be machined in order to assist in the elimination of burrs about the periphery of the through-hole during the punching step.

An air chamber 4 defined by the upper face of the flange 5, the inner face of the bushing 2 and the outer circumferential face of the pierce-punch 1, and compressed air, which is supplied by a compressor 15, is introduced via a vent 9. The pressure in the air chamber 4 is kept at a prescribed value in order to bias the knock-out bushing 3 downward, so that the lower end of the knock-out bushing 3 is located below the lower end of the bushing 2 when the knock-out bushing 3 is at its lower limit of travel.

The upper base X is affixed to and vertically reciprocated by a press mechanism (not shown).

Furthermore, a lower die-set-member has a lower base Y, and a punch 6 is fixed to and extended upward from the lower base Y. The punch 6 is the same as the punch 314 shown in FIGS. 1–6. There are formed a first tapered face 13 (corresponding to the tapered face 322 in FIG. 1) and a second tapered face (not shown but corresponding to the second tapered face 318 in FIG. 1) on the outer circumferential face of the punch 6, wherein the angle $\theta 2$ is 2 degrees. The punch 6 has a hollow section 8 and the upper end diameter of the hollow section 8 is less than the diameter of the lower end hollow section 8. The front end of the pierce-punch 1 enters the hollow section 8 when the upper base X descends. The punch 6 passes through a hole in a biased table 7, which is biased upward by biasing means 14, e.g. a spring. The tapered upper end of the punch 6 is projected upward from the top face of the biased table 7. Note that, the second tapered face of the punch and the second reverse-tapered face of the die (see FIGS. 1–6) are not shown in FIG. 8 because the angles $\theta 1$ and $\theta 2$ are quite small (2 degrees).

Next, the functioning of the device shown in FIG. 8 will be explained with reference to FIGS. 9A, 9B, 9C and 9D.

Figure 9A:
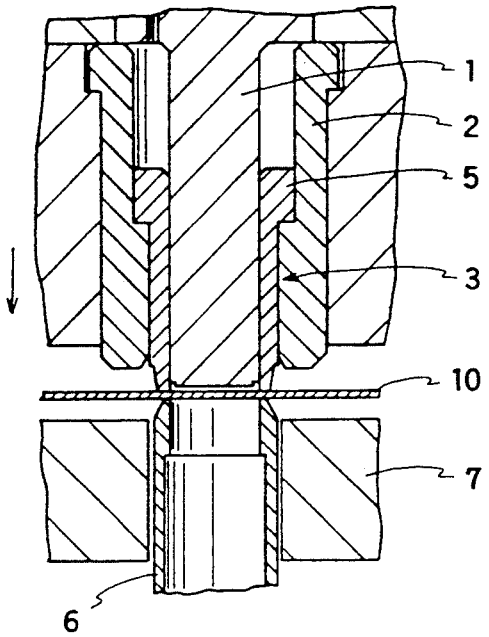
FIGS. 9A, 9B, 9C and 9D are sectional views showing the action of the device shown in FIG. 8.
Figure 9B:
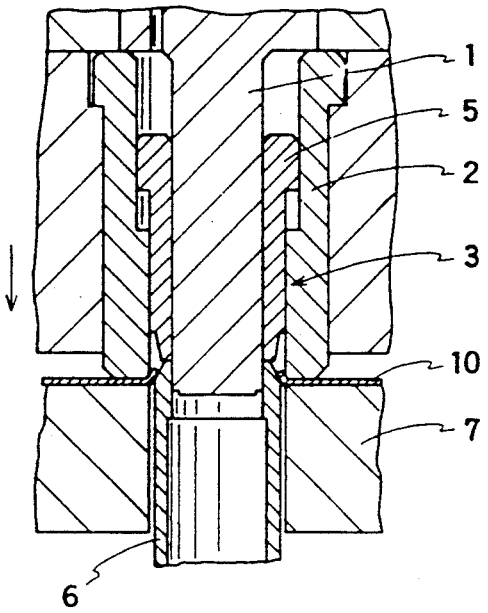

The metal plate 10 is positioned perpendicularly to the punch 6 (see FIG. 9A). Then, the upper base X is lowered by the press mechanism (not shown). The knock-out bushing 3 is biased downward by compressed air introduced into the air chamber 4 via vent 9, so that the flange 5 is located at its lowest limit. The lower end of the knock-out bushing 3 presses the metal plate 10 against the upper end face of the punch 6 fixing the metal plate 10 in position by the force of the air pressure in the air chamber 4 (see FIG. 9A). After engaging the metal plate 10, the knock-out bushing 3 does not continue to descend downward with the upper base X; the knock-out-bushing 3 stops at a prescribed position.

The downward force of the press mechanism is greater than the force of the air pressure in air chamber 4, so that the flange 5 of the knock-out bushing 3 is capable of moving to its upper limits of travel within the air chamber 4. In this structure, the upper base X descends together with the pierce-punch 1 and the bushing 2 while keeping the knock-out-bushing 3 in a fixed position of contact with metal plate 10. The pierce-punch 1 punches the through-hole using the punch 6 as a die.

The lower end of the bushing 2 presses the metal plate 10 onto the top face of the biased table 7. The first tapered face 13 of the punch 6 burrs the through-hole in metal plate 10 to form the projected section about the edge of the through-hole. At that time, the lower end face of the knock-out bushing 3 directly contacts the front end face of the punch 6 (see FIG. 9B) and the projected section of the metal plate 10 is gripped by the lower interior corner of the bushing 2 and the upper outer circumferential face of punch 6.

Figure 2B:
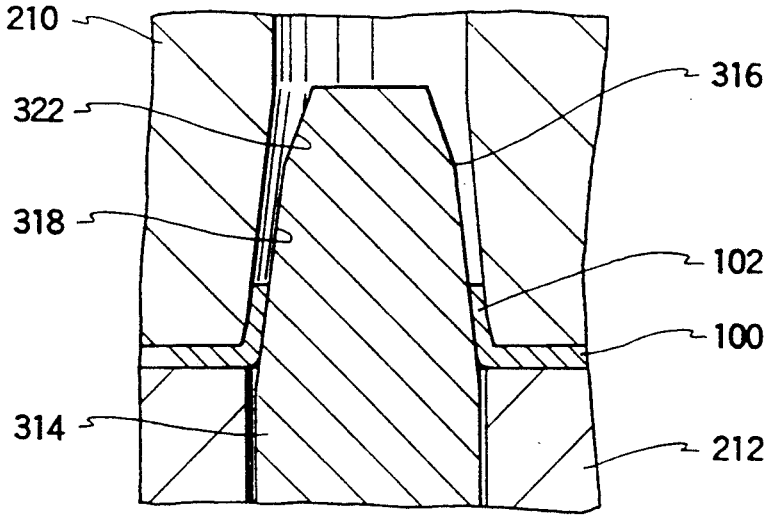

Next, the upper base X descends, and presses both the metal plate 10 and the biased table 7 downward. The projected section (corresponding to the projected section 102 in FIGS. 1–5) which has been burred by the inner face of the bushing 2 and the upper outer circumferential face of the punch 6, is extruded as shown in FIGS. 2B and 3, to make the collar with a prescribed height.

Figure 9C:
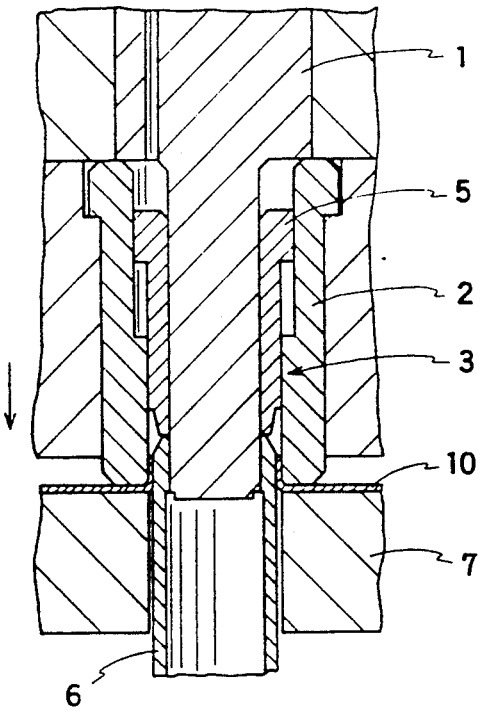

The pierce-punch 1 descends coincidentally with the upper base X, and the lower end thereof slides within the inner face of the punch 6 (see FIG. 9C). The lower end section of the pierce-punch 1, descending through the upper end section of the punch 6, prevents the punch 6 from suffering any diameter reduction caused by the exterior forces working thereto during the extrusion step.

Upon forming the collar with the prescribed height, the descent of the upper base X is halted and then the upper base X ascends. The pierce-punch 1 and the bushing 2 ascend coincidentally with the upper base X.

Figure 9D:
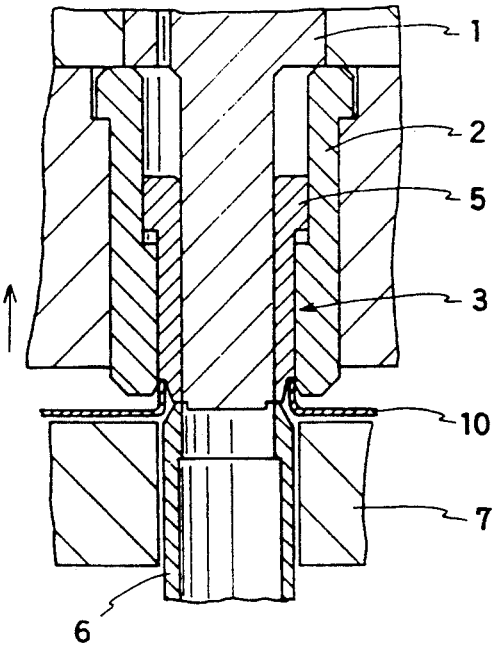
Figure 11A:
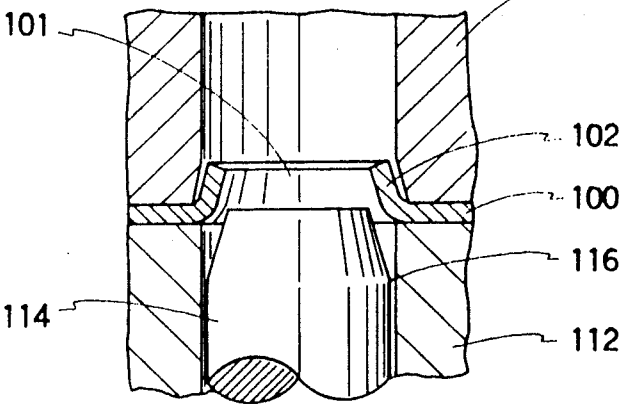
FIG. 11A PRIOR ART
FIGS. 11A and 11B are sectional views showing a conventional ironing die set.
Figure 11B:
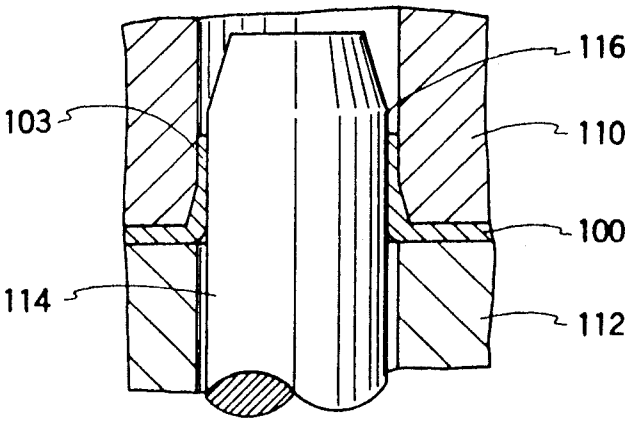
FIG. 11B PRIOR ART
Figure 10A:
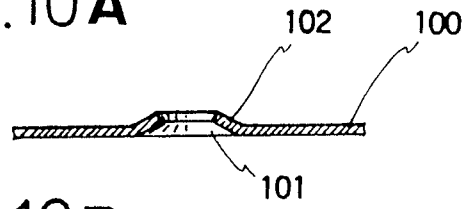
FIGS. 10A, 10B, 10C and 10D are sectional views showing steps of manufacturing fins of heat exchangers.
Figure 10B:
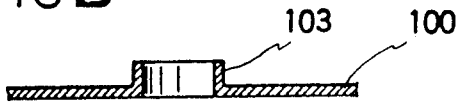
Figure 10C:
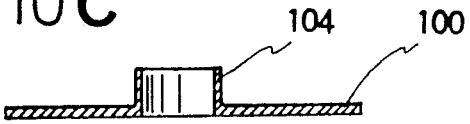
Figure 10D:
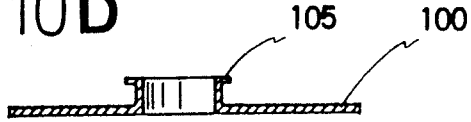

Simultaneously, the knock-out bushing 3 maintains contact with the upper end face of the punch 6 until the flange 5 returns to its lower limit of travel within the air chamber 4, said movement causing separation of the metal plate 10 from the bushing 2 (see FIG. 9D). The knock-out bushing 3 begins to ascend with the upper base X after the flange 5 reaches the lowest possible position within the air chamber 4.

If the height of the collar formed by the above described steps is less than the prescribed height, the collar may be extruded again. Once the height of the collar reaches the prescribed height, the upper end of the collar may be bent outward to form the flange 105 (see FIG. 10D).

In the device shown in FIGS. 8 and 9A–9D, the knock-out bushing 3 is biased downward by the pressure of compressed air but it may, of course, be biased by any suitable biasing means, for example, a spring.

There may be provided an air port in the center of the pierce-punch 1 so as to blow chips from the die set and assist in cooling during machining.

The present invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A die set for manufacturing fins of heat exchangers, comprising:

a punch and a die for forming a projected section, which is formed along an edge of a hole punched in a metal plate, into a collar with a prescribed height, said die has a hollow section into which said punch enters; and an outer circumferential face of said punch is a tapered face in the form of a truncated cone, a corner section being formed at an end of the tapered face positioned a predetermined distance from a front end of the punch, a slope of an outer side of the punch changing at the corner section, the punch having a predetermined length from the end thereof to the corner section, wherein said tapered face faces an inner face of said die when the front end section of said punch proceeds beyond the front end of said projected section, which is held between the outer circumferential face of said punch and the inner face of said die, and said projected section is extruded by reduction of the distance between the outer circumferential face of said punch and the inner face of said die, which hold said projected section therebetween, caused by movement of said tapered face of said punch into the hollow section of said die, the predetermined length of the punch from the end thereof to the corner section being established such that said corner section is moved through and beyond said projected section as said projected section is extruded.

2. The die set according to claim 1, wherein a part of the inner face of said die, which faces the outer circumferential face of said punch when said punch enters into the hollow section of said die, is a first reverse-tapered face in the form of a hollow truncated cone corresponding to said tapered face of said punch.

3. The die set according to claim 2, wherein the angle of said tapered face and said first reverse-tapered face is between 30 minutes of angle and 4 degrees of angle.

4. The die set according to claim 2, wherein the angle of said tapered face and said first reverse-tapered face is between 1 degree of angle and 3 degrees of angle.

5. The die set according to claim 2, wherein said die has at the lower end a second reverse-tapered section in the form of a hollow truncated cone for guiding the punch into the hollow section of the die, and an angle of the second reverse-tapered section is greater than an angle of the first reverse-tapered section.

6. The die set according to claim 1 wherein, the upper end diameter d of a first tapered section, which includes said tapered face, the minimum diameter D of the portion of the hollow section of said die to which said projected section corresponds when the projected section is inserted into the hollow section of the die, and the thickness t of the projected section satisfy the following equation (1):

$$(D-d) \geqq t \quad (1);$$

and the lower end diameter $\phi$ of said first tapered section, the minimum diameter D, and the thickness t satisfy the following equation (2) whereby movement of the punch into the die reduces the distance between the tapered face of the punch and the inner face of the die, which together engage said projected section when the upper end section of the punch enters into the hollow section of the die, such that said reduced distance is less than the thickness t:

$$(D-\phi)/2 < t \quad (2).$$

7. The die set according to claim 6, wherein the upper end diameter d is at the corner section of the truncated cone.

8. The die set according to claim 1 wherein, the upper end diameter d of a first tapered section, which includes said tapered face, the minimum diameter D of the part of the hollow section of said die in which said projected section corresponds when the projected section is inserted into the hollow section of the die, and the thickness t of the projected section satisfy following equation (3):

$$0 < (D-d)/2 < t \quad (3);$$

and the lower end diameter $\phi$ of the first tapered section, the minimum diameter D, and the thickness t satisfy the following equation (4) whereby movement of the punch into the die reduces the distance between the tapered face of the punch and the inner face of the die, which together engage the projected section when the upper end section of the punch enters into the hollow section of the die, such that said reduced diameter is less than the thickness t:

$$(D-\phi)/2 < t \quad (4).$$

9. The die set according to claim 8, wherein the upper end diameter d is at the corner section of the truncated cone.

10. The die set according to claim 1, wherein said punch has at the upper end a second tapered section in the form of a truncated cone for guiding the into the hollow section of the die, and an angle of the second tapered section is greater than an angle of the first tapered section.

11. The die set according to claim 10, wherein the corner section is between the first tapered section and the second tapered section.

12. The die set according to claim 1, further comprising means for ejecting the punch from the die.

13. The die set according to claim 12, wherein at least one of the punch and the means for ejecting has an oil supply path, the oil supply path extending generally along a longitudinal length of the one of the punch and the means for ejecting, the oil supply path being generally centrally located in the one of the punch and the means for ejecting.

14. The die set according to claim 13, wherein both the punch and the means for ejecting have the oil supply path generally centrally located therein.

15. The die set according to claim 1, wherein the punch has an oil supply path extending generally along a longitudinal length thereof, the oil supply path being generally centrally located in the punch.

16. The die set according to claim 1, wherein the corner section is on a lower side of the tapered face and is spaced the predetermined distance from the front end of the punch, the outer side of the punch generally only having one change in slope, the one change in slope being at the corner section.

17. A device for manufacturing fins of heat exchangers comprising:

an upper die-set-member and a lower die-set-member for forming a projected section, which is formed along an edge of a hole punched in a metal plate, into a collar with a prescribed height, said upper die-set member further comprising:

an upper vertically reciprocable base;

a die being fixed to said upper base and extended vertically downward, said die has a hollow section with an inner diameter slightly greater than an outer diameter of said collar at the lower end;

a hollow cylindrical knock-out bushing being provided in the hollow section of the die, the knock-out bushing being vertically reciprocable, the knock-out bushing being biased downward by a first biasing means so that a lower end of the knock-out bushing is located below a lower end of the die when the knock-out bushing is positioned at a lowest travel limit; and a rod-like pierce-punch, said pierce-punch being provided in the knock-out bushing, the pierce-punch being vertically reciprocable coincidental to a corresponding movement of the upper base, an outer diameter of the pierce-punch is less than an inner diameter of the collar; and the lower die-set-member further comprises:

a lower base;

a punch being fixed to the lower base and extended vertically upward to correspond to the die, the punch has a hollow section with an outer diameter slightly less than the inner diameter of the collar, the upper end section of the punch is a tapered section in the form of a truncated cone with a corner section being formed at an end of the cone spaced a predetermined distance from a front end of the punch, a slope of an outer side of the punch changing at the corner section, the punch having a predetermined length from the end thereof to the corner section, wherein the punch enters the die and the pierce-punch enters the punch when the upper die-set-member moves downward; and a biased plate being biased upward by a second biasing member, the biased plate is loosely penetrated by the punch and the tapered section is projected therefrom, wherein the tapered section of the punch faces to an inner face of the die, the predetermined length of the punch being established such that the front end of the punch and the corner section proceeds beyond an upper end of the projected section, which is held between an outer circumferential face of the punch and the inner face of the die, and the projected section so held is extruded by reduction of distance between the outer circumferential face of the punch and the inner surface of the die, which engage the projected section therebetween, caused by movement of the tapered face of the punch into the hollow section of the die.

18. The device according to claim 17, wherein said first biasing means is compressed air.

19. The device according to claim 17, further comprising an oil supply path located in the punch, the oil supply path extending along a longitudinal length of the punch and being generally centrally located in the punch.

20. A method for forming fins of heat exchangers comprising the steps of:

providing a metal plate with a projected section surrounding a hole therein;

placing the metal plate between a punch and a die;

grasping the metal plate between the punch and the die, the hole in the metal plate being generally centered with the punch;

providing a truncated cone section on the punch, the cone section having a tapered face and having a corner section spaced a predetermined distance from a front end of the punch, slope of the punch changing at the corner section;

moving the punch into the projected section;

extruding the projected section by reducing distance between an outer circumferential face of said punch and an inner face of said die, the distance being reduced by the movement of the punch into the projected section and into the die; and moving the corner section of the punch beyond an upper edge of the projected section.

21. The method for forming according to claim 20, wherein diameter of the punch at the corner section is less than an inner diameter of the projected section and wherein the step of extruding further comprises the step of using only a portion of the punch below the corner section during the extruding.

22. The method for forming according to claim 20, further comprising the step of ironing the projected section with the corner section, the ironing taking place before the step of moving the corner section beyond the upper edge of the projected section.

23. The method for forming according to claim 20, further comprising the steps of:

providing a second truncated cone section on the punch, the second truncated cone section being located above the first truncated cone, the corner section being located between the first and second truncated cone sections; and guiding the punch into the hole of the projected section with the second truncated cone before the step of extruding.

24. The method for forming according to claim 20, wherein the corner section is on a lower side of the truncated cone section and is spaced the predetermined distance from the end of the punch, the outer side of the punch generally only having one change in slope, the one change being at the corner section, the step of extruding being carried out after the step of moving the punch into the projected section and before the step of moving the corner section of the punch beyond the upper edge of the projected section.

25. The method for forming according to claim 20, further comprising the step of providing an oil supply path in the punch, the oil supply path extending generally along a longitudinal length of the punch and being generally centrally located in the punch.

* * * * *